US006920874B1

(12) United States Patent
Siegel

(10) Patent No.: US 6,920,874 B1
(45) Date of Patent: Jul. 26, 2005

(54) INTELLIGENT VENTILATING SAFETY RANGE HOOD

(76) Inventor: Robert Paul Siegel, 52 Woodside Dr., Penfield, NY (US) 14526

( * ) Notice: Subject to any disclaimer, the term of this patent is extended or adjusted under 35 U.S.C. 154(b) by 0 days.

(21) Appl. No.: 10/790,542

(22) Filed: Mar. 1, 2004

(51) Int. Cl.[7] ..... F24B 1/00

(52) U.S. Cl. ..... 126/299 R; 126/299 D; 126/39 G; 126/21 A; 454/236; 236/44 C

(58) Field of Search ..... 126/299 R, 299 D, 126/39 G, 21 A; 454/229, 236; 236/44 C

(56) References Cited

U.S. PATENT DOCUMENTS

| | | | | | |
|---|---|---|---|---|---|
| 2,807,994 | A | | 10/1957 | Bernstein | 126/299 D |
| 3,125,869 | A | | 3/1964 | Winton | 62/317 |
| 3,359,885 | A | | 12/1967 | Faehling | 126/299 D |
| 3,690,245 | A | | 9/1972 | Fealase | 126/299 D |
| 4,133,300 | A | | 1/1979 | Burton, Jr. | 126/299 D |
| 4,614,177 | A | | 9/1986 | Buckley | 126/299 R |
| 5,139,009 | A | * | 8/1992 | Walsh | 126/299 R |
| 5,140,120 | A | * | 8/1992 | Kasai et al. | 219/710 |
| 5,186,260 | A | | 2/1993 | Scofield | 169/65 |
| 5,207,276 | A | | 5/1993 | Scofield | 169/61 |
| 5,232,152 | A | | 8/1993 | Tsang | 236/44 A |
| 5,386,099 | A | * | 1/1995 | Has | 219/413 |
| 5,810,244 | A | | 9/1998 | Ngai | 236/44 C |
| 5,976,010 | A | | 11/1999 | Reese et al. | 454/229 |
| 6,053,809 | A | | 4/2000 | Arceneaux | 454/228 |
| 6,170,480 | B1 | * | 1/2001 | Melink et al. | 126/299 R |
| 6,426,703 | B1 | | 7/2002 | Johnston | 340/628 |
| 6,578,569 | B2 | * | 6/2003 | Liese | 126/299 R |
| 2002/0176809 | A1 | * | 11/2002 | Siess | 422/121 |

* cited by examiner

*Primary Examiner*—Stephen Gravin

(57) ABSTRACT

An improved ventilating range hood that drives a variable speed fan according to the state of four distinct air quality sensors: temperature, humidity, Carbon monoxide and smoke. A micro-controller is used to integrate the four signals and determine the appropriate ventilation requirement. This value is converted into a signal to drive the fan. Visual indicators are provided to display the state of each air quality factor. An audible alarm is activated if the levels remain at hazardous levels for more than a predetermined time interval after the fan has been turned on.

18 Claims, 4 Drawing Sheets

INTELLIGENT VENTILATING SAFETY RANGE HOOD

BACKGROUND OF THE INVENTION

1. Field of the Invention

This disclosure relates generally to ventilating range hoods and, in particular, to a device that senses the air for the presence of certain hazardous elements and controls a variable speed fan in response to those elements, in such a way as to increase the comfort and safety of the surrounding area.

2. Background

Modern homes are being built with increasing emphasis on energy efficiency. This generally means more thermal insulation, more vapor barriers and better quality seals around windows and doors. This type of construction has given rise to the concern that ventilation may be inadequate, in light of the need for a continuous supply of fresh air and concerns about volatile byproducts of manufacturing of synthetic items. There is further concern in the many homes that use combustible fuels for heating and cooking or lighting. In addition to the psychometric comfort factors of heat and humidity and the essential need for oxygen, there are the serious health factors of carbon monoxide, smoke, and any other products of combustion deriving from these activities. Excess heat and humidity in an enclosed structure can also be quite destructive to the structure itself, leading to problems ranging from mildew, to insulation failure, to deterioration of the actual structure itself through attraction of insects and rot.

In 1998, there were approximately 200 deaths and 5000 injuries attributed to residential, non-vehicle, carbon monoxide (CO) poisoning in the US. While equipment malfunctions, such as cracked heat exchangers played a role, a key factor in all of these injuries and deaths was inadequate ventilation. Roughly 10% of these casualties have been attributed to gas stoves and ovens. Low-level cases are more difficult to track, since the symptoms are similar to common cold or flu, but are likely to have a much higher occurrence. Thus, considering the impact of lost work days and reduced activity due to illness for low-level exposure, and the injury and death resulting from high level exposure, the cost to society of inadequate ventilation in conjunction with combustion appliances is substantial.

The ASME standards for gas stoves, which allow for trace amounts of CO, are based on the assumption that the stoves are vented. However, many are not and even those that are generally use a range hood with a fan that must be switched on manually. Many people do not turn these venting fans on unless there is detectable smoke or odor or if the kitchen becomes excessively hot. In other words, kitchens are often inadequately ventilated to a degree that may be a health and safety concern.

In the case of CO, which, being colorless and odorless is undetectable without some sort of electronic device, it is difficult to detect CO being emitted by a cooking appliance since the installation instructions for plug-in detectors recommend placing them a minimum distance away from such appliances so as to avoid setting off an alarm due to transient levels emitted from said cooking appliances. The alarms, being on/off devices must receive some minimum level of contamination before activating the alarm. The alarms are useful for notifying building occupants of the hazard although they do nothing beyond this to ameliorate the situation. The same is true for smoke detectors as well.

The device disclosed herein was invented to address these concerns, by providing an inexpensive, automated and effective response to the presence of the factors of heat, humidity, CO and smoke and smoke or other similar hazards in a kitchen as the result of cooking or introduced by some other means.

A variety of range hoods have been developed in an attempt to provide ventilation of cooking related exhaust fumes and other volatile waste products. Examples of such devices are found in U.S. Pat. Nos. 4,133,300, 4,614,177, 3,125,869 and 3,359,885. While these and other devices represent improvements in the art of ventilating heat and fumes generated by cooking food, they fail to provide the automatic safety features enabled by the current disclosure.

U.S. Pat. No. 2,807,994 to Samuel M. Bernstein, issued Oct. 1, 1957 combines a ventilating range hood with an exhaust fan. U.S. Pat. No. 3,690,245 to Ferlise, et al, in Sep. 12, 1972 provides a range hood in which the fan can be automatically switched on when cooking is detected by means of built-in thermostats. The fan is also switched off in the presence of fire. The fan is set to switch on when the temperature in the duct exceeds 140° F. which indicate that cooking is taking place. If the duct temperature exceeds 2408° F., the fan is shut down on the assumption that there is a fire.

U.S. Pat. No. 5,186,260 to William Scofield, issued Feb. 16, 1993 discloses a range hood with a wire heat sensor which triggers a fire extinguisher if excessive temperatures are detected. U.S. Pat. No. 5,207,276 by the same inventor, improves upon the fusible link triggering system with the use of an explosive squib.

U.S. Pat. No. 5,232,152 to Richard Tsang, issued Aug. 3, 1993 shows a range hood connected to a humidity sensor. The fan is automatically activated if the humidity exceeds a certain preset level. The patent allows for a remotely located sensor in addition to a sensor integrated into the hood. The hood allows for both automatic and manual modes of operation.

Automatic ventilating systems that respond to temperature and humidity have been disclosed in the area of general ventilation, as well in systems that are responsive to smoke. U.S. Pat. No. 6,053,809, to Henry Arceneaux, issued Apr. 25, 2000 automatically raises a building ceiling panel in the presence of smoke and activates an optional fan. U.S. Pat. No 5,810,244 to Ngai, issued Sep. 22, 1998 describes a ventilating fan controlled by both temperature and humidity sensors using a microprocessor controller. U.S. Pat. No. 4,726,824 to Staten, issued Feb. 23, 1988, describes a building level system for indoor pollution control which utilizes air quality sensors to monitor for various pollutants including carbon monoxide. The system has a display which indicates the presence of these unwanted pollutants and responds to their presence by conditioning the air by means of a variety of filters. U.S. Pat. No. 5,976,010 to Reese, et al, issued Nov. 2, 1999 describes an energy-efficient building level system for indoor air quality that senses the carbon dioxide level in a room and if an undesirable level is detected, actively reduces that level by mixing the air with air from other rooms.

And plug-in or battery operated smoke detectors and carbon monoxide detectors have become as popular residential safety items. U.S. Pat. No. 6,426,703 to Johnston, et al, issued Jul. 30, 2002 describes a smoke and carbon monoxide detector that are combined and integrated into a single unit. Like the myriads of individual detectors devices available, this device will issue an alarm if either smoke or carbon monoxide is detected.

While the above-described devices are effective for their intended purpose, there is nevertheless a need, and a consumer desire, for an improved range hood that responds automatically to the various airborne hazards found in the a kitchen, particularly carbon monoxide and smoke which actively purges these hazards rather than just sounding an alarm and utilizes a smart controller to ensure the appropriate response to multiple, sometimes conflicting signals. The net result is a ventilating exhaust fan that consistently provides the appropriate operating speed as well as an alarm to be sounded if the hazard levels become dangerous despite the fan action.

SUMMARY OF THE INVENTION

Accordingly, a Smart Range Hood is disclosed that includes a sheet metal collecting hood designed to be vented outdoors, equipped with a variable speed fan, a group of air quality sensors including, temperature, humidity, carbon monoxide and smoke, and a micro-controller that determines the appropriate fan speed based on the levels detected by each of the sensors as well as the support electronics required to enable the controller to read the inputs and drive the fan. The micro-controller utilizes an algorithm that combines the output of the four sensors in order to derive an overall ventilation requirement. The ventilation requirement is then translated into a signal that initiates the appropriate fan speed, which, in turn, produces an appropriate ventilation air flow rate. If, despite the highest degree of airflow deployed in response to a hazard condition, the detected contaminant presence remains at a hazardous level, an alarm is sounded.

The hood is also equipped with an override control which allows the user to turn the fan on to a desired level manually and to shut the fan off, under extenuating circumstances, though this is not recommended as a general practice. Display indicators are provided to indicate when the hood is responding to any of the four inputs, and at what level.

The air quality sensors, which are based on commercially available, off the shelf technology, are mounted in such a way as to sample both the air stream drawn into the hood through forced convection as well as the ambient air in the surrounding living space. The sensors will sample these air streams at periodic intervals and the algorithm will consider both the instantaneous readings as well as the trend as determined from recent history.

These and other features and advantages are described in or apparent from the following detailed description of the exemplary embodiments.

BRIEF DESCRIPTION OF THE DRAWINGS

The foregoing and other features of the exemplary embodiments will be apparent and easily understood from a further reading of the specification, claims and by reference to the accompanying drawings in which like reference numerals refer to like elements and wherein:

DETAILED DESCRIPTION OF THE INVENTION

Figure 1:
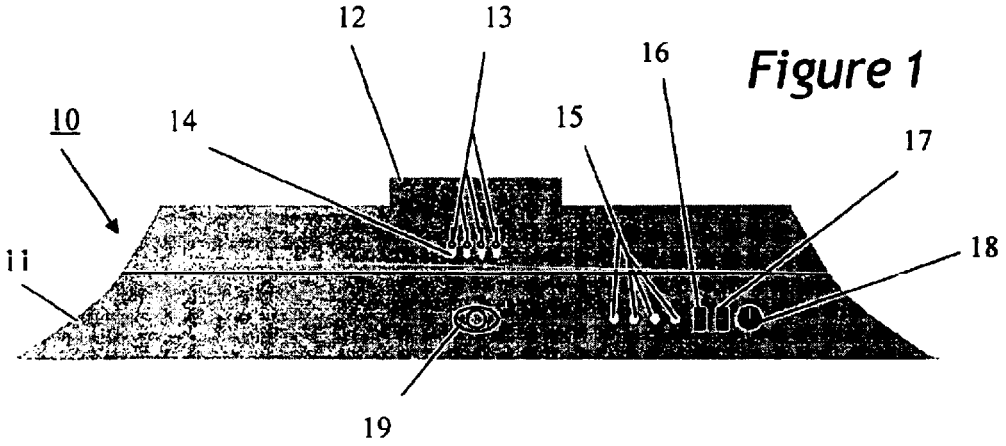
FIG. 1 is a front view of a Smart Range Hood apparatus.

While preferred embodiments will be described hereinafter, it will be understood that it is not intended to limit the disclosure to those embodiments. On the contrary, it is intended to cover all alternatives, modifications, and equivalents as may be included within the spirit and scope of the disclosure as defined by the appended claims.

For a general understanding of the features of the exemplary embodiments, reference is made to the drawings. In the drawings, like reference numerals have been used throughout to identify identical elements. FIGS. 1–7 schematically depict various views illustrating an improved range hood incorporating the features of the present invention therein including description of the control scheme which is essential to its operation. It will become evident from the following discussion that the disclosed range hood may be employed in a wide variety of applications for ventilating habitable spaces and is not specifically limited in its application to the particular apparatus and method specifically mentioned herein.

Figure 2:
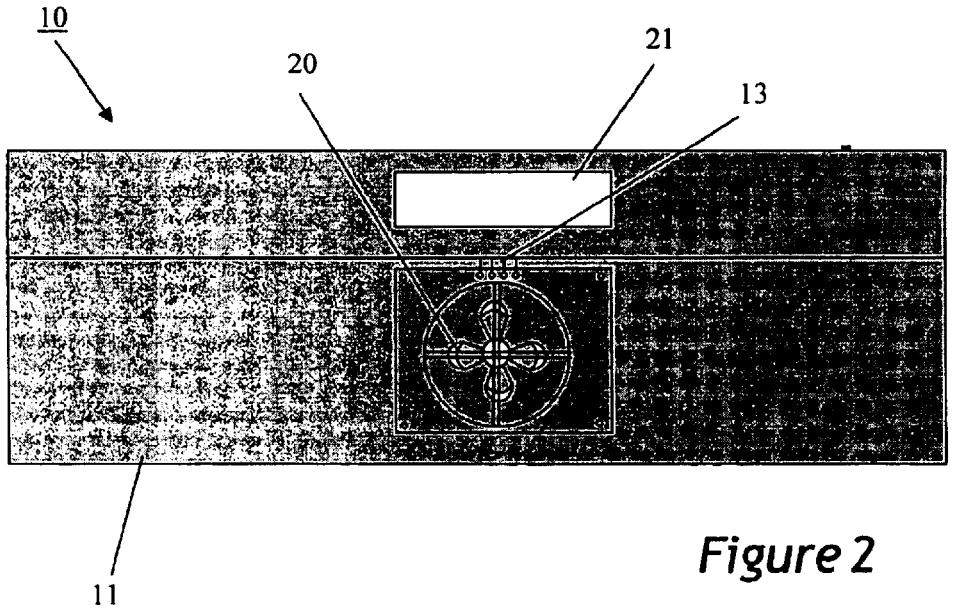
FIG. 2 is a bottom view of a Smart Range Hood apparatus.

Referring now to FIGS. 1 and 2, various views are shown illustrating the Smart Range Hood 10. In FIG. 1, a sheet metal enclosure commonly known as a hood 11 connects to external venting ductwork through a plenum adapter 12. It contains a series of openings 14 through which the various air quality sensors 13 can be exposed to air in the ambient environment as well as to the air that is being drawn up through the ductwork by the fan 20 of FIG. 2 and through plenum adapter 12. Alternatively, the fan could be attached to the ductwork on the outside of the structure being ventilated, if desired. A series of indicators 15, one each corresponding to the sensors, displays the status of the ventilating system with regard to the current level of each hazard. It is envisioned that a green indication will reflect a level of that particular hazard that is within acceptable limits. A yellow indication will reflect that a hazard condition has been detected and that remediation, in the form of ventilating airflow, is underway. A red indication reflects the fact that the hazard has reached a dangerous level despite the remediating airflow and that evacuation or other emergency action should be taken. If this condition should persist for more than a few seconds, an audible alarm 19 is sounded. The combination of the red indictor and the audible alarm will inform the occupants as well as emergency personnel as to the cause of the alarm. While the primary operation is automatic, a number of manual controls are provided to be used in the manual mode. A light switch 16 allows the user to control the light. A second switch 17 allows the user to switch the fan operation between manual and automated modes. In manual mode, the smart range hood behaves in a manner that is identical to a conventional range hood. A rotary speed control 18 is provided lo for use when the Smart Range Hood is operating in manual mode. It bears repeating that while this is a preferred embodiment of the Smart Range Hood and its appearance and user interface, there are many variations possible that reflect the same underlying concept.

FIG. 2 shows the Smart Range Hood, when viewed from underneath FIG. 1. In this view, the variable speed fan 20 is shown. This fan has been selected for its variable speed operation and its high volume of airflow under the operating conditions typical of a ducted exhaust fan where pressure drops would be those associated with ducting and filter losses. Flow rate would range from several hundred cubic feet per minute (cfm) to a thousand cfm or more depending on the requirement for a particular model. The air quality sensors 13 can also be seen in this view since they protrude into the air stream enabling them to sample air from the stream of air being exhausted as well as the ambient air in the room. An overhead light 21 is also shown.

Figure 3:
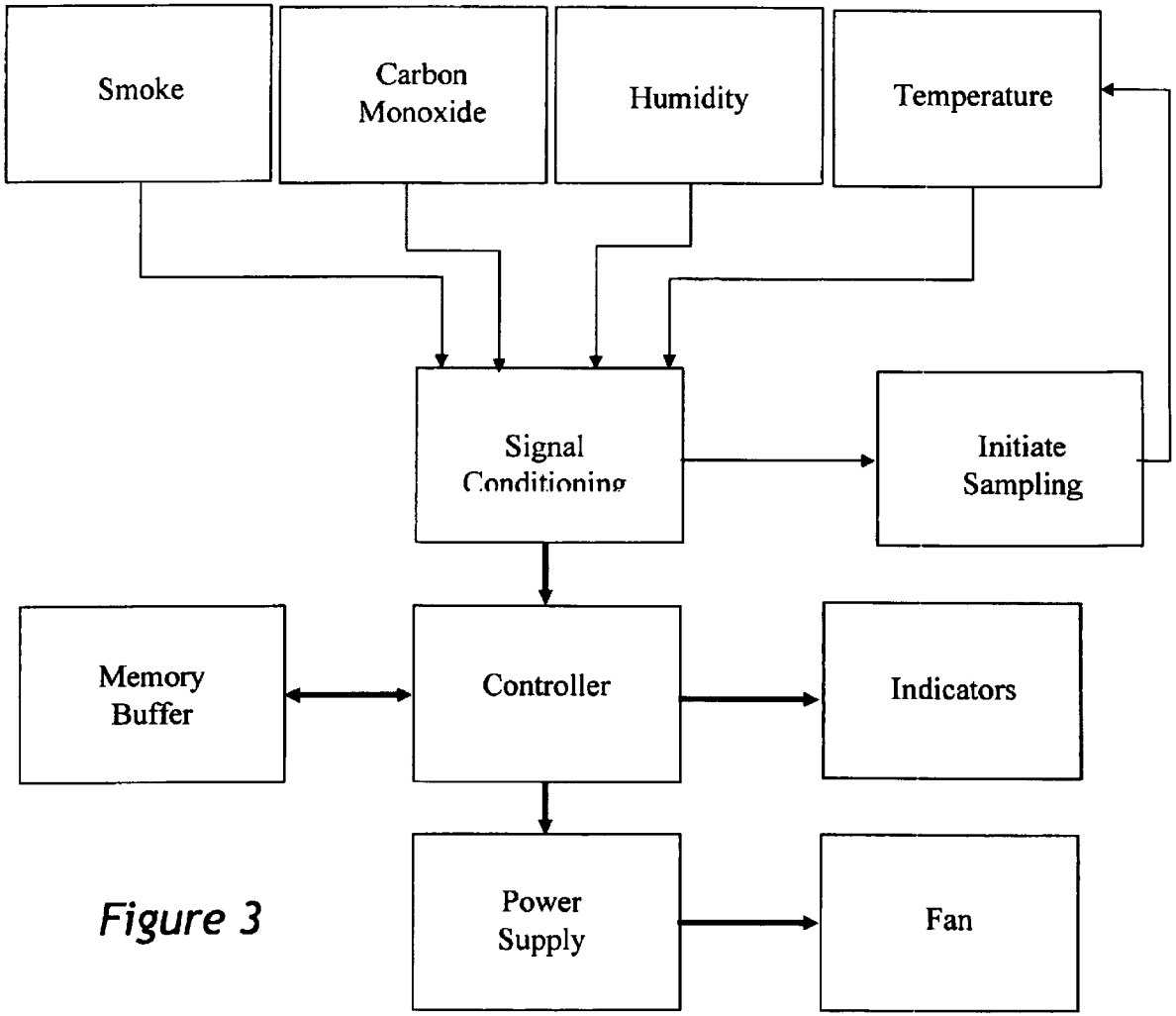
FIG. 3 is a simple flow chart illustrating the controller function.

FIG. 3 is a block diagram illustrating the top-level control function. The output signals from the four air quality sensors: smoke 30, carbon monoxide 31, temperature 32 and humidity 33, initiated by sampling block 38, are fed into the signal conditioning front end circuitry 35 of the micro-controller 36. This circuitry provides a time base, sample clocking, filtering, amplification and scaling as necessary as well as analog-to-digital conversion. At each scheduled request, the signals enter this stage as noisy, non-scaled, analog voltages and leave as essentially clean, time-stamped digital representations of the level of each of the four inputs. The micro-controller 36 stores several readings in a memory buffer 37 as a means of defining recent history. This is used to dynamically determine if the level of each of the four inputs is increasing, decreasing or remaining the same. The micro-controller 36 then applies the embedded control algorithm which examines the composite output of the four sensors as well as the trend information and determines from them an instantaneous ventilation requirement. The ventilation requirement is then displayed on the indicators 15 for each of the factors. The net result is then fed as a control signal to the power supply 39 which provides the driving voltage to regulate the fan speed 40, if a DC fan is used, or, if a pulse-width-modulated control scheme is used, the ventilation requirement result is translated into a PWM duty cycle which will, in turn, drive the fan at the appropriate speed.

While the present disclosure can potentially be implemented with a variety of control schemes that integrate the output signals of any number of air is quality sensors to determine a ventilation requirement and drive the fan accordingly, the preferred embodiment described herein is shown with a fuzzy logic controller. Fuzzy logic control is convenient because it allows microprocessor control to be applied in areas where an explicit mathematical model does not exist or is not known. Instead, the math model is replaced by a set of heuristic, or experiential rules, that can be converted to mathematical form through a process called fuzzification. Thus, a controller of this sort can be constructed based on rules of the following (simplified) form:

If CO level is HAZARD, turn fan on to MAXIMUM speed.

If Smoke level is HEAVY SMOKE, turn fan on to MAXIMUM speed.

If Temperature is WARM and Humidity is HUMID, turn fan on LOW.

If Temperature indicates FIRE, then turn fan OFF.

The development of a Fuzzy Logic Controller (FLC) requires three distinct steps:

(1) the fuzzification of input values where specific values of the controller inputs are mapped to the linguistic labels by means of the membership functions (2) a set of fuzzy if-then inferencing rules are developed which define relationship between the inputs and the outputs (3) a defuzzification process which converts the output labels selected by the application of the inputs to the rules back into numerical values.

Figure 4:
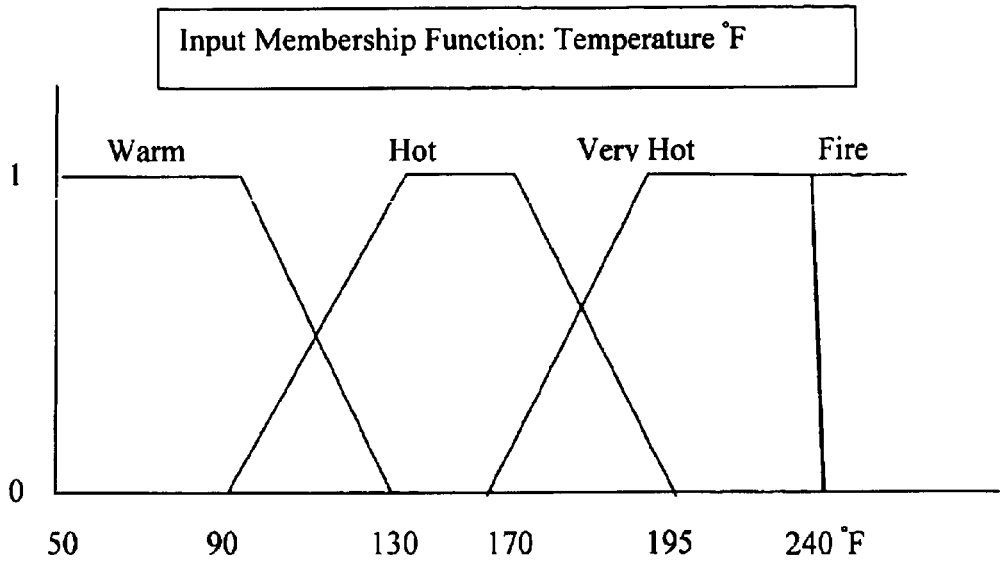
FIG. 4 is a chart showing the weighted membership functions for the fuzzy logic control algorithm for the Temperature input.

Fuzzy logic differs from Boolean logic in that statement can be both true and false to a certain degree. Thus if the temperature is somewhere between warm and hot, the statement, the temperature is warm, may be 30% true, and the statement, the temperature is hot, may be 70% true. In this case the resulting action would be a weighted average between the response for warm and the response for hot. The membership functions map the degree of membership of each parameter to the associated linguistic labels such as warm, hot, etc. FIG. 4 is the membership function for temperature. From this we can see that anything up to 90° is considered warm and everything between 130° and 170° is considered hot. Between 90° and 130°, the temperature is both warm and hot to varying degrees as displayed by the function, which in this case is linear. Similarly, at 195° the temperature is considered very hot, which would call for even higher fan speed. Between 170° and 195°, the temperature is both hot and very hot to varying degrees according to the linear function shown. But at 240°, it is assumed that a fire is taking place. In this case, the fan is turned off and the alarm is sounded.

Figure 5:
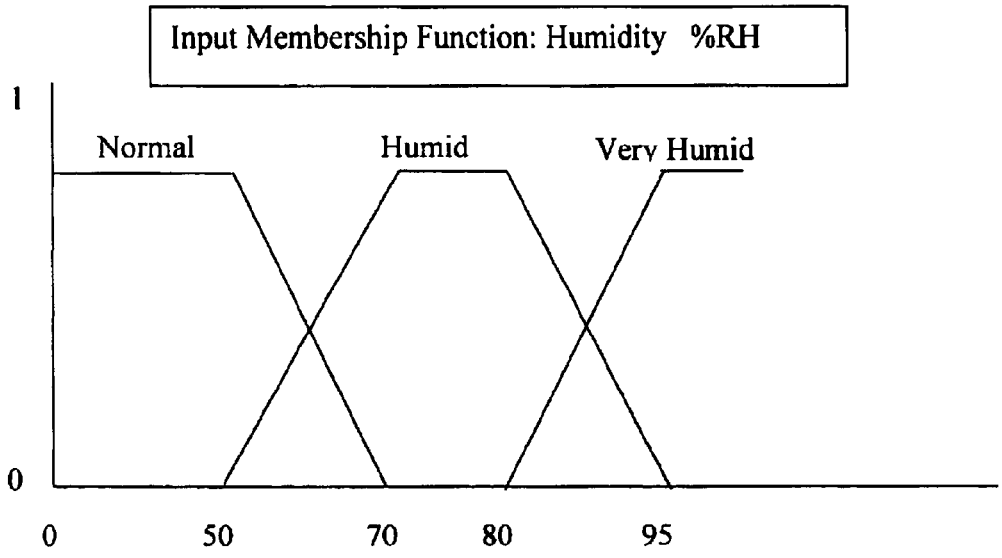
FIG. 5 is a chart showing the weighted membership functions for the fuzzy logic control algorithm for the Humidity input.

FIG. 5 shows the membership function for humidity. Humidity in a cooking environment is expected to be high. Anything below 50% is considered normal, meaning no additional ventilation is required. Between 50 and 70% it is becoming humid. Between 70 and 80% is considered humid. Between 80% and 95% is becoming very humid. Anything above 95% RH is very humid. Note that these values are illustrative of one particular implementation. Other implementations are possible and may be desirable under certain conditions, for example, in high altitude areas, or areas of extremely dry or wet climate.

Figure 6:
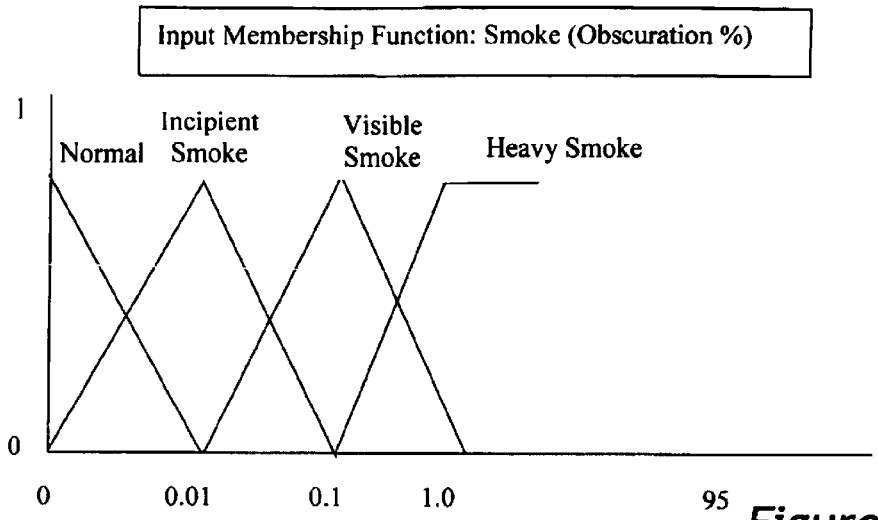
FIG. 6 is a chart showing the weighted membership functions for the fuzzy logic control algorithm for the Carbon monoxide level input.

FIG. 6 shows the membership function for smoke. This is measured in obscuration %. Anything below 0.01% is considered pure air. Between 0.01 and 0.1% is considered incipient smoke. Anything above 0.1 is considered visible smoke and anything above 1.0% is considered heavy smoke.

Figure 7:
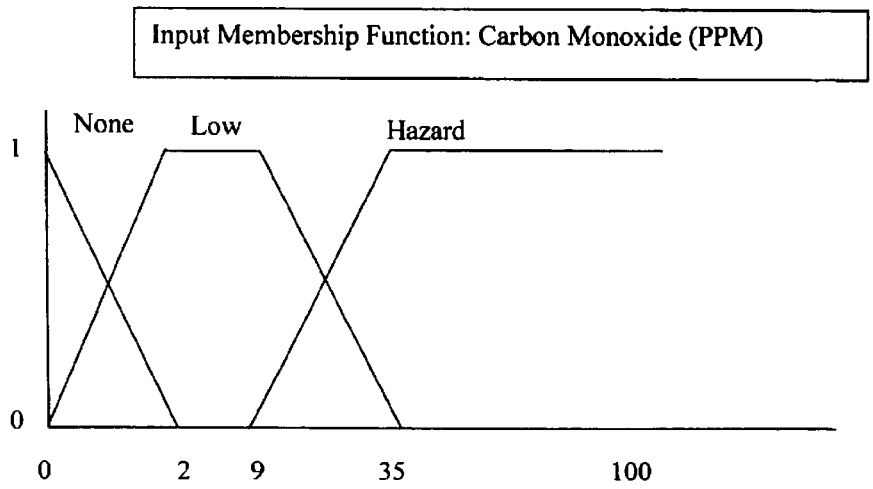
FIG. 7 is a chart showing the weighted membership functions for the fuzzy logic control algorithm for the Smoke input.

FIG. 7 shows the membership function for CO in parts per million (PPM). Here we have only three levels, none, low and hazard. That is because only a very low level of CO is considered tolerable. Anything between 2 and 9 PPM is considered low and anything above 35 is considered hazardous.

The complete rules are of the form:

If Temperature is A and Humidity is B and Carbon Monoxide is C and Smoke is D; then Fan Speed is E. These are shown in the following tables: Since there are four levels of temperature, three levels of humidty, four levels of smoke and three levels of CO, that results in a total of 144 rules. For example, the first rule would read: If the Temperature is Warm, the Humidity is Normal, Smoke is Normal, and CO is None: there is no need for ventilation and the fan speed should be set to OFF. However, in the next rule, where the CO level moves up to Low, the fan speed is set to HIGH, to attempt to flush the contaminant out.

These rules should be taken as initial settings. Additional rules can be added to consider the current trend as mentioned earlier. If, for example, in the previous case, the CO level remains at Low for some time, without dropping back to None, the fan speed should be increased until there is no detectable trace of contaminant.

TABLE 1

Fuzzy Rules for Temperature = Warm

| Rule # | Temperature | Humidity | Smoke | CO | Fan |
|---|---|---|---|---|---|
| 1 | Warm | Normal | Normal | None | Off |
| 2 | Warm | Normal | Normal | Low | High |
| 3 | Warm | Normal | Normal | Hazard | Maximum |
| 4 | Warm | Normal | Incipient | None | Medium |
| 5 | Warm | Normal | Incipient | Low | High |
| 6 | Warm | Normal | Incipient | Hazard | Maximum |
| 7 | Warm | Normal | Visible | None | High |
| 8 | Warm | Normal | Visible | Low | High |
| 9 | Warm | Normal | Visible | Hazard | Maximum |
| 10 | Warm | Normal | Heavy | None | Maximum |
| 11 | Warm | Normal | Heavy | Low | Maximum |
| 12 | Warm | Normal | Heavy | Hazard | Maximum |
| 13 | Warm | Humid | Normal | None | Low |
| 14 | Warm | Humid | Normal | Low | High |
| 15 | Warm | Humid | Normal | Hazard | Maximum |
| 16 | Warm | Humid | Incipient | None | Medium |
| 17 | Warm | Humid | Incipient | Low | High |
| 18 | Warm | Humid | Incipient | Hazard | Maximum |
| 19 | Warm | Humid | Visible | None | High |
| 20 | Warm | Humid | Visible | Low | High |
| 21 | Warm | Humid | Visible | Hazard | Maximum |
| 22 | Warm | Humid | Heavy | None | Maximum |
| 23 | Warm | Humid | Heavy | Low | Maximum |
| 24 | Warm | Humid | Heavy | Hazard | Maximum |
| 25 | Warm | Very Humid | Normal | None | Medium |
| 26 | Warm | Very Humid | Normal | Low | High |
| 27 | Warm | Very Humid | Normal | Hazard | Maximum |
| 28 | Warm | Very Humid | Incipient | None | Medium |
| 29 | Warm | Very Humid | Incipient | Low | High |
| 30 | Warm | Very Humid | Incipient | Hazard | Maximum |
| 31 | Warm | Very Humid | Visible | None | High |
| 32 | Warm | Very Humid | Visible | Low | High |
| 33 | Warm | Very Humid | Visible | Hazard | Maximum |
| 34 | Warm | Very Humid | Heavy | None | Maximum |
| 35 | Warm | Very Humid | Heavy | Low | Maximum |
| 36 | Warm | Very Humid | Normal | Hazard | Maximum |

TABLE 2

Fuzzy Rules for Temperature = Hot

| Rule # | Temperature | Humidity | Smoke | CO | Fan |
|---|---|---|---|---|---|
| 37 | Hot | Normal | Normal | None | Low |
| 38 | Hot | Normal | Normal | Low | High |
| 39 | Hot | Normal | Normal | Hazard | Maximum |
| 40 | Hot | Normal | Incipient | None | Medium |
| 41 | Hot | Normal | Incipient | Low | High |
| 42 | Hot | Normal | Incipient | Hazard | Maximum |
| 43 | Hot | Normal | Visible | None | High |
| 44 | Hot | Normal | Visible | Low | High |
| 45 | Hot | Normal | Visible | Hazard | Maximum |
| 46 | Hot | Normal | Heavy | None | Maximum |
| 47 | Hot | Normal | Heavy | Low | Maximum |
| 48 | Hot | Normal | Heavy | Hazard | Maximum |
| 49 | Hot | Humid | Normal | None | Low |
| 50 | Hot | Humid | Normal | Low | High |
| 51 | Hot | Humid | Normal | Hazard | Maximum |
| 52 | Hot | Humid | Incipient | None | Medium |
| 53 | Hot | Humid | Incipient | Low | High |
| 54 | Hot | Humid | Incipient | Hazard | Maximum |
| 55 | Hot | Humid | Visible | None | High |
| 56 | Hot | Humid | Visible | Low | High |
| 57 | Hot | Humid | Visible | Hazard | Maximum |
| 58 | Hot | Humid | Heavy | None | Maximum |
| 59 | Hot | Humid | Heavy | Low | Maximum |
| 60 | Hot | Humid | Heavy | Hazard | Maximum |
| 61 | Hot | Very Humid | Normal | None | Medium |
| 62 | Hot | Very Humid | Normal | Low | High |
| 63 | Hot | Very Humid | Normal | Hazard | Maximum |
| 64 | Hot | Very Humid | Incipient | None | High |
| 65 | Hot | Very Humid | Incipient | Low | High |

TABLE 2-continued

Fuzzy Rules for Temperature = Hot

| Rule # | Temperature | Humidity | Smoke | CO | Fan |
|---|---|---|---|---|---|
| 66 | Hot | Very Humid | Incipient | Hazard | Maximum |
| 67 | Hot | Very Humid | Visible | None | High |
| 68 | Hot | Very Humid | Visible | Low | High |
| 69 | Hot | Very Humid | Visible | Hazard | Maximum |
| 70 | Hot | Very Humid | Heavy | None | Maximum |
| 71 | Hot | Very Humid | Heavy | Low | Maximum |
| 72 | Hot | Very Humid | Normal | Hazard | Maximum |

TABLE 3

Fuzzy Rules for Temperature = Very Hot

| Rule # | Temperature | Humidity | Smoke | CO | Fan |
|---|---|---|---|---|---|
| 73 | Very Hot | Normal | Normal | None | High |
| 74 | Very Hot | Normal | Normal | Low | High |
| 75 | Very Hot | Normal | Normal | Hazard | Maximum |
| 76 | Very Hot | Normal | Incipient | None | High |
| 77 | Very Hot | Normal | Incipient | Low | High |
| 78 | Very Hot | Normal | Incipient | Hazard | Maximum |
| 79 | Very Hot | Normal | Visible | None | High |
| 80 | Very Hot | Normal | Visible | Low | High |
| 81 | Very Hot | Normal | Visible | Hazard | Maximum |
| 82 | Very Hot | Normal | Heavy | None | Maximum |
| 83 | Very Hot | Normal | Heavy | Low | Maximum |
| 84 | Very Hot | Normal | Heavy | Hazard | Maximum |
| 85 | Very Hot | Humid | Normal | None | Medium |
| 86 | Very Hot | Humid | Normal | Low | High |
| 87 | Very Hot | Humid | Normal | Hazard | Maximum |
| 88 | Very Hot | Humid | Incipient | None | High |
| 89 | Very Hot | Humid | Incipient | Low | High |
| 90 | Very Hot | Humid | Incipient | Hazard | Maximum |
| 91 | Very Hot | Humid | Visible | None | High |
| 92 | Very Hot | Humid | Visible | Low | High |
| 93 | Very Hot | Humid | Visible | Hazard | Maximum |
| 94 | Very Hot | Humid | Heavy | None | Maximum |
| 95 | Very Hot | Humid | Heavy | Low | Maximum |
| 96 | Very Hot | Humid | Heavy | Hazard | Maximum |
| 97 | Very Hot | Very Humid | Normal | None | High |
| 98 | Very Hot | Very Humid | Normal | Low | High |
| 99 | Very Hot | Very Humid | Normal | Hazard | Maximum |
| 100 | Very Hot | Very Humid | Incipient | None | High |
| 101 | Very Hot | Very Humid | Incipient | Low | High |
| 102 | Very Hot | Very Humid | Incipient | Hazard | Maximum |
| 103 | Very Hot | Very Humid | Visible | None | High |
| 104 | Very Hot | Very Humid | Visible | Low | High |
| 105 | Very Hot | Very Humid | Visible | Hazard | Maximum |
| 106 | Very Hot | Very Humid | Heavy | None | Maximum |
| 107 | Very Hot | Very Humid | Heavy | Low | Maximum |
| 108 | Very Hot | Very Humid | Normal | Hazard | Maximum |

TABLE 4

Fuzzy Rules for Temperature = Fire

| Rule # | Temperature | Humidity | Smoke | CO | Fan |
|---|---|---|---|---|---|
| 109 | Fire | Normal | Normal | None | Off |
| 110 | Fire | Normal | Normal | Low | Off |
| 111 | Fire | Normal | Normal | Hazard | Off |
| 112 | Fire | Normal | Incipient | None | Off |
| 113 | Fire | Normal | Incipient | Low | Off |
| 114 | Fire | Normal | Incipient | Hazard | Off |
| 115 | Fire | Normal | Visible | None | Off |
| 116 | Fire | Normal | Visible | Low | Off |
| 117 | Fire | Normal | Visible | Hazard | Off |
| 118 | Fire | Normal | Heavy | None | Off |
| 119 | Fire | Normal | Heavy | Low | Off |
| 120 | Fire | Normal | Heavy | Hazard | Off |
| 121 | Fire | Humid | Normal | None | Off |

TABLE 4-continued

Fuzzy Rules for Temperature = Fire

| Rule # | Temperature | Humidity | Smoke | CO | Fan |
|---|---|---|---|---|---|
| 122 | Fire | Humid | Normal | Low | Off |
| 123 | Fire | Humid | Normal | Hazard | Off |
| 124 | Fire | Humid | Incipient | None | Off |
| 125 | Fire | Humid | Incipient | Low | Off |
| 126 | Fire | Humid | Incipient | Hazard | Off |
| 127 | Fire | Humid | Visible | None | Off |
| 128 | Fire | Humid | Visible | Low | Off |
| 129 | Fire | Humid | Visible | Hazard | Off |
| 130 | Fire | Humid | Heavy | None | Off |
| 131 | Fire | Humid | Heavy | Low | Off |
| 132 | Fire | Humid | Heavy | Hazard | Off |
| 133 | Fire | Very Humid | Normal | None | Off |
| 134 | Fire | Very Humid | Normal | Low | Off |
| 135 | Fire | Very Humid | Normal | Hazard | Off |
| 136 | Fire | Very Humid | Incipient | None | Off |
| 137 | Fire | Very Humid | Incipient | Low | Off |
| 138 | Fire | Very Humid | Incipient | Hazard | Off |
| 139 | Fire | Very Humid | Visible | None | Off |
| 140 | Fire | Very Humid | Visible | Low | Off |
| 141 | Fire | Very Humid | Visible | Hazard | Off |
| 142 | Fire | Very Humid | Heavy | None | Off |
| 143 | Fire | Very Humid | Heavy | Low | Off |
| 144 | Fire | Very Humid | Normal | None | Off |

Notice that certain inputs dominate the rules as common sense dictates. For example, as Table 4 shows, if Fire is detected, the fan is shut off regardless of what the other inputs are. Likewise, in all cases not involving a fire, if smoke is Heavy or if CO is at the Hazard level, the fan is set to Maximum, regardless of the other inputs. This set of rules is shown as an illustrative example of a workable embodiment of the disclosure. Other rules sets can be proposed that also embody the underlying disclosure but may be preferable in some cases.

The next step is to mathematically define the linguistic labels for fan speed, which will allow us to convert the rule outcomes to numerical values.

TABLE 5

Definition table for Fan Speed Output

| Label | % of Maximum Speed |
|---|---|
| Off | 0 |
| Low | 25 |
| Medium | 50 |
| High | 75 |
| Maximum | 100 |

We are now ready to defuzzify. To see how this would work, consider the following example. The Smart Range Hood is installed in kitchen. A meal is cooking. The temperature at the hood is 110° F. The relative humidity is 74%. Smoke is 0.08% visible obscuration and CO level is 0 ppm. Referring to the membership functions, we can see that the temperature of 110° F. is halfway between 90° and 130°, which means it has a membership of 0.5 in Warm and 0.5 in Hot. The RH @ 74% is 1.0 in Humid. Smoke @ 0.08% has a membership of 0.8 in visible smoke and 0.2 in incipient smoke and CO @ 0 ppm represents a membership of 1.0 in None. This would invoke the following four rules: 17,19,52 and 55. This can be best shown in the following Defuzzification Table.

TABLE 6

Defuzzification Table for Example

| Rule | Temperature | Humidity | Smoke | CO | Output |
|---|---|---|---|---|---|
| 17 | 0.5 | 1.0 | 0.2* | 1.0 | Medium |
| 19 | 0.5* | 1.0 | 0.8 | 1.0 | High |
| 52 | 0.5 | 1.0 | 0.2* | 1.0 | Medium |
| 55 | 0.5* | 1.0 | 0.8 | 1.0 | High |

Note that the lowest value for each input has an asterisk. The lowest value drives each rule.

So Rule 17, which has an output of Medium or 50% of full speed is driven by a weight of 0.2 and Rule 19, which has an output of High, or 75%, is driven by a weight of 0.5.

So our result is:

$$(0.2)*(0.5)+(0.5)*(0.75)=0.475 \text{ or } 47.5\% \text{ of maximum speed.}$$

Rules 52 and 55 are not used in this case, since the Medium and High outputs were already represented by the first two rules.

As noted earlier, certain values, such as hazardous levels of either smoke or CO will override this algorithm and turn the fan immediately on at maximum. If the sensor levels do not drop to a lower level within a period of approximately one minute, the audible alarm will be sounded.

In summary, a system has been disclosed that senses the air in and around a range hood for the presence of particular hazardous elements and activates an exhaust fan to purge those elements to ensure a safe and healthy indoor environment. The system includes a collecting hood, a variable speed exhaust fan, a series of sensors capable of detecting the presence of various hazardous elements including, but not limited to, temperature, humidity, carbon monoxide and smoke, a controller capable of integrating the signals from the various sensors and deriving from them a ventilation requirement, the support electronics necessary to drive the fan in accordance with said ventilation requirement, a means of display to indicate the presence of each of the hazardous elements and an audible alarm that can be activated if excessively hazardous levels are detected.

It will be apparent to those skilled in the art that various modifications and variations can be made in the disclosed method and apparatus without departing from the spirit and scope of the disclosure. Other embodiments of the disclosure will be apparent to those skilled in the art from consideration of the specification and practice of the disclosure. It is intended that the specification and the disclosed means be considered as exemplary only, with the full scope of the disclosure being defined by the following claims.

What is claimed is:

1. An improved ventilating range hood, comprising:

a sheet metal collecting hood, vented to the outdoors;

a variable speed, electronically controllable fan, mounted in such a way as to draw air from a cooking area and out through said vent of said collecting hood;

a plurality of air quality sensors capable of detecting both comfort factors and the presence of hazardous substances in the air;

an embedded control algorithm which examines the composite output of said discrete air quality sensors, as well as, the trend information and determines from said information an instantaneous ventilation requirement, and a control signal, derived from said algorithm to regulate the fan speed level such that every combination of discrete air quality sensor conditions will have a unique associated fan speed level based on said ventilation requirement.

2. The improved range hood of claim 1, wherein said air quality sensors include sensors for temperature, humidity, carbon monoxide and smoke.

3. The improved range hood of claim 2, including an audible alarm that is activated if despite the highest decree of airflow deployed in response to a hazard condition, the detected contaminant presence remains at a hazardous level for longer than a predetermined period of time.

4. The improved range hood of claim 3, including a mounted display panel that indicates the status of each substance of the hazardous elements.

5. The improved range hood of claim 4, wherein said controller uses a fuzzy logic control algorithm that provides the appropriate fan motor speed based on a computed ventilation requirement such that the air quality sensor outputs are mapped into linguistic labels by means of membership functions that can in turn be used with experiential rules of the form: IF Smoke is MEDIUM and CO is LOW, THEN Fan speed should be MEDIUM;

and such that two different input conditions such as Temperature is HOT and Temperature is WARM can be true to different degrees depending on the actual temperature and the way that the membership functions that map the inputs to the labels are drawn;

and such that the resulting action prescribed by the controller would be a weighted average that reflects the degree to which each of the input conditions are true.

6. The improved range hood of claim 5, wherein said variable speed fan motor is controlled by a pulse-width modulated input.

7. The improved range hood of claim 5, where said controller stores multiple readings in memory, so as to determine if there is an upward or downward trend in the measured signal.

8. The improved range hood of claim 7, wherein said air quality sensors are used to detect the presence of a fire, and if a fire is detected, said variable speed fan is turned OFF and an audible alarm is turned ON.

9. A smart range hood, comprising:

a vent connected to said range hood and vented to the outdoors;

a variable speed fan connected to said vent;

a plurality of air quality sensors;

a micro-controller, said micro-controller being adapted to examine the composite output of said air quality sensors, as well as, the trend information arising from them, and determine from said information, an instantaneous ventilation requirement; and a control signal, produced by said micro-controller to regulate the fan speed such that every combination of air quality sensor levels will have a unique associated fan speed based on said ventilation requirement.

10. The range hood of claim 9, wherein said plurality of air quality sensors include, temperature, humidity, carbon monoxide and smoke sensors.

11. The range hood of claim 10, wherein said micro-controller utilizes an algorithm that combines the output of said plurality of air quality sensors in order to derive an output ventilation requirement.

12. The range hood of claim 10, including an override control which allows a user to turn said variable speed fan ON to a desired level manually and to shut said variable speed fan OFF.

13. The range hood of claim 12, wherein said air quality sensors are mounted to sample both the air stream drawn into said range hood through forced convection, as well as, the ambient air in the surrounding living space.

14. A system that senses the air in and around a range hood for the presence of particular hazardous elements, comprising:

a collecting hood;

a variable speed fan;

a series of sensors adapted to sense predetermined hazardous elements;

a controller adapted to integrate signals from said series of sensors, as well as, the trend information arising from them, and determine from said information, an instantaneous ventilation requirement, and a control signal, produced by said controller to regulate the fan speed such that every combination of air quality sensor levels will have a unique associated fan speed based on said ventilation requirement.

15. The system of claim 14, including a display adapted to indicate the presence of each of said particular hazardous elements.

16. The system of claim 15, wherein said display includes an audible alarm that is activated if despite the highest degree of airflow deployed in response to a hazard condition, the detected contaminant presence remains at a hazardous level for longer than a predetermined period of time.

17. The system of claim 14, wherein said controller uses a fuzzy logic control algorithm to provide appropriate fan speed based on computed ventilation requirements in such a way that;

the air quality sensor outputs are mapped into linguistic labels by means of membership functions that can in turn be used with experiential rules of the form: IF Smoke is MEDIUM and CO is LOW, THEN Fan speed should be MEDIUM;

and such that two different input conditions such as Temperature is HOT and Temperature is WARM can be true to different degrees depending on the actual temperature and the way that the membership functions that map the inputs to the labels are drawn;

and such that the resulting action prescribed by the controller would be a weighted average that reflects the degree to which each of the input conditions are true.

18. The system of claim 14, wherein said variable speed fan is mounted exterior to the structure being ventilated.

* * * * *